US011236938B2

(12) United States Patent
Yang et al.

(10) Patent No.: US 11,236,938 B2
(45) Date of Patent: Feb. 1, 2022

(54) RECESSED REFRIGERATOR

(71) Applicant: QINGDAO HAIER CO., LTD., Qingdao (CN)

(72) Inventors: Chun Yang, Qingdao (CN); Lisheng Ji, Qingdao (CN); Enpin Xia, Qingdao (CN); Hao Zhang, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 47 days.

(21) Appl. No.: 16/643,520

(22) PCT Filed: Dec. 26, 2018

(86) PCT No.: PCT/CN2018/123739
§ 371 (c)(1),
(2) Date: Feb. 28, 2020

(87) PCT Pub. No.: WO2019/141054
PCT Pub. Date: Jul. 25, 2019

(65) Prior Publication Data

US 2020/0348071 A1 Nov. 5, 2020

(30) Foreign Application Priority Data

Jan. 22, 2018 (CN) ..... 201810060788.3

(51) Int. Cl.
*F25D 23/00* (2006.01)
*F25D 23/06* (2006.01)

(52) U.S. Cl.
CPC ..... *F25D 23/003* (2013.01); *F25D 23/061* (2013.01); *F25D 2323/00261* (2013.01); *F25D 2323/00271* (2013.01)

(58) Field of Classification Search
CPC ..... F25D 23/003; F25D 2323/0261; F25D 2323/00271; F25D 2323/00266;
(Continued)

(56) References Cited

U.S. PATENT DOCUMENTS 2,768,512 A * 10/1956 Philipp ..... F25D 23/003 62/455
2005/0210884 A1* 9/2005 Tuskiewicz ..... F25D 17/06 62/3.6

FOREIGN PATENT DOCUMENTS

CN 1470832 A 1/2004
CN 101069052 A 11/2007
(Continued)

OTHER PUBLICATIONS

English Language Translation of CN101069052, Translated Jun. 10, 2021 (Year: 2005).*

*Primary Examiner* — Cassey D Bauer
(74) *Attorney, Agent, or Firm* — Cheng-Ju Chiang

(57) ABSTRACT

The present invention discloses a recessed refrigerator supported on a supporting surface, the refrigerator including a cabinet, a door movably disposed at a front side of the cabinet, a compressor compartment formed in a rear lower portion of the refrigerator and a compressor and a heat dissipating fan located in the compressor compartment, the cabinet including a bottom plate, the bottom plate being disposed apart from the supporting surface, and the bottom plate including a compressor compartment bottom plate located below the compressor compartment, the compressor compartment bottom plate being formed with a main air inlet and a main air outlet communicating the external with the compressor compartment, air from the external, driven by the heat dissipating fan, entering the compressor compartment through the main air inlet and then flowing to the external through the main air outlet.

4 Claims, 2 Drawing Sheets

(58) Field of Classification Search
CPC . F25D 2323/02736; F25D 2323/00261; F25D 2323/00276; F25D 23/061
See application file for complete search history.

(56) References Cited

FOREIGN PATENT DOCUMENTS

| | | | |
|---|---|---|---|
| CN | 107421204 | A | 12/2017 |
| CN | 108444168 | A | 8/2018 |
| DE | 19933603 | A1 | 1/2001 |

* cited by examiner

RECESSED REFRIGERATOR

The present application is a 35 U.S.C. § 371 National Phase conversion of International (PCT) Patent Application No. PCT/CN2018/123739, filed on Dec. 26, 2018, which claims priority to Chinese Patent Application No. 201810060788.3, filed on Jan. 22, 2018 and tiled "RECESSED REFRIGERATOR", which is incorporated herein by reference in its entirety. The PCT International Patent Application was filed and published in Chinese.

TECHNICAL FIELD

The invention relates to a recessed refrigerator, and belongs to the field of refrigeration equipment.

BACKGROUND

At present, recessed refrigerators are usually arranged in an installation space in a wall cabinet, a wall or a cupboard, improve the utilization rate of the space and indoor design conciseness, and appeal to people.

However, since the recessed refrigerators are disposed in a limited space and blocked around by the wall cabinet, the wall or the cupboard, the heat in a compressor compartment cannot be efficiently removed in time, which reduces the refrigerating effect of the recessed refrigerators.

SUMMARY

To solve the problem that the heat released by the compressor cannot be efficiently discharged in time due to blocking, the present disclosure provides a recessed refrigerator of which heat-dissipating efficiency is high.

To achieve one of the above objects, an embodiment of the present invention provides a recessed refrigerator supported on a supporting surface, the refrigerator comprising a cabinet, a door movably disposed at a front side of the cabinet, a compressor compartment formed in a rear lower portion of the refrigerator and a compressor and a heat dissipating fan located in the compressor compartment, the cabinet comprising a bottom plate, the bottom plate being disposed apart from the supporting surface, and the bottom plate comprising a compressor compartment bottom plate located below the compressor compartment, the compressor compartment bottom plate being formed with a main air inlet and a main air outlet communicating the external with the compressor compartment, air from the external, driven by the heat dissipating fan, entering the compressor compartment through the main air inlet and then flowing to the external through the main air outlet.

As a further improvement of an embodiment of the present invention, the refrigerator further comprises a partition plate extending downward from the bottom plate and located between the main air inlet and the main air outlet.

As a further improvement of an embodiment of the present invention, when the refrigerator is supported on the supporting surface, the partition plate abuts against the supporting surface.

As a further improvement of an embodiment of the present invention, the partition plate extends in a front-rear direction, the compressor compartment bottom plate comprises a left end portion on a left side of the partition plate and a right end portion on a right side of the partition plate, the main air inlet is formed on one of the left end portion and the right end portion, and the main air outlet is formed on the other of the left end portion and the right end portion.

As a further improvement of an embodiment of the present invention, a front end of the partition plate is flush with a front end of the bottom plate.

As a further improvement of an embodiment of the present invention, the refrigerator further comprises a wind baffle extending downward out of the bottom plate, and the wind baffle is connected to the partition plate and located behind the main air outlet.

As a further improvement of an embodiment of the present invention, when the refrigerator is supported on the supporting surface, the wind baffle abuts against the supporting surface.

As a further improvement of an embodiment of the present invention, when the main air outlet is formed on the left end portion, the wind baffle extends from the partition plate in a left-right direction to below a left side plate of the cabinet; when the main air outlet is formed on the right end portion, the wind baffle extends from the partition plate in the left-right direction to below a right side plate of the cabinet.

As a further improvement of an embodiment of the present invention, the main air outlet is at least partially located below the compressor.

As a further improvement of an embodiment of the present invention, the cabinet further comprises a left side plate at a left end of the compressor compartment, a right side plate at a right end of the compressor compartment, and two secondary air ports, the two secondary air ports are formed on the left side plate and the right side plate respectively and communicate the external with the compressor compartment, one of the secondary air ports allows external air to enter the compressor compartment, and the other of the secondary air ports allows air to flow from the compressor compartment to the external.

As compared with the prior art, the present invention has the following advantageous effects: the heat in the compressor compartment can be effectively and timely discharged and the refrigeration effect of the refrigerator can be ensured; at the same time, the back plate of the refrigerator may be set against to the cupboard or the wall, thereby saving space and avoiding the appearance of hygienic dead angles.

DETAILED DESCRIPTION

The present invention will be described below in detail in combination with specific embodiments illustrated in drawings. However, these embodiments have no limitations on the present invention, and any transformations of structure, method, or function made by persons skilled in the art according to these embodiments fall within the protection scope of the present invention.

Figure 1:
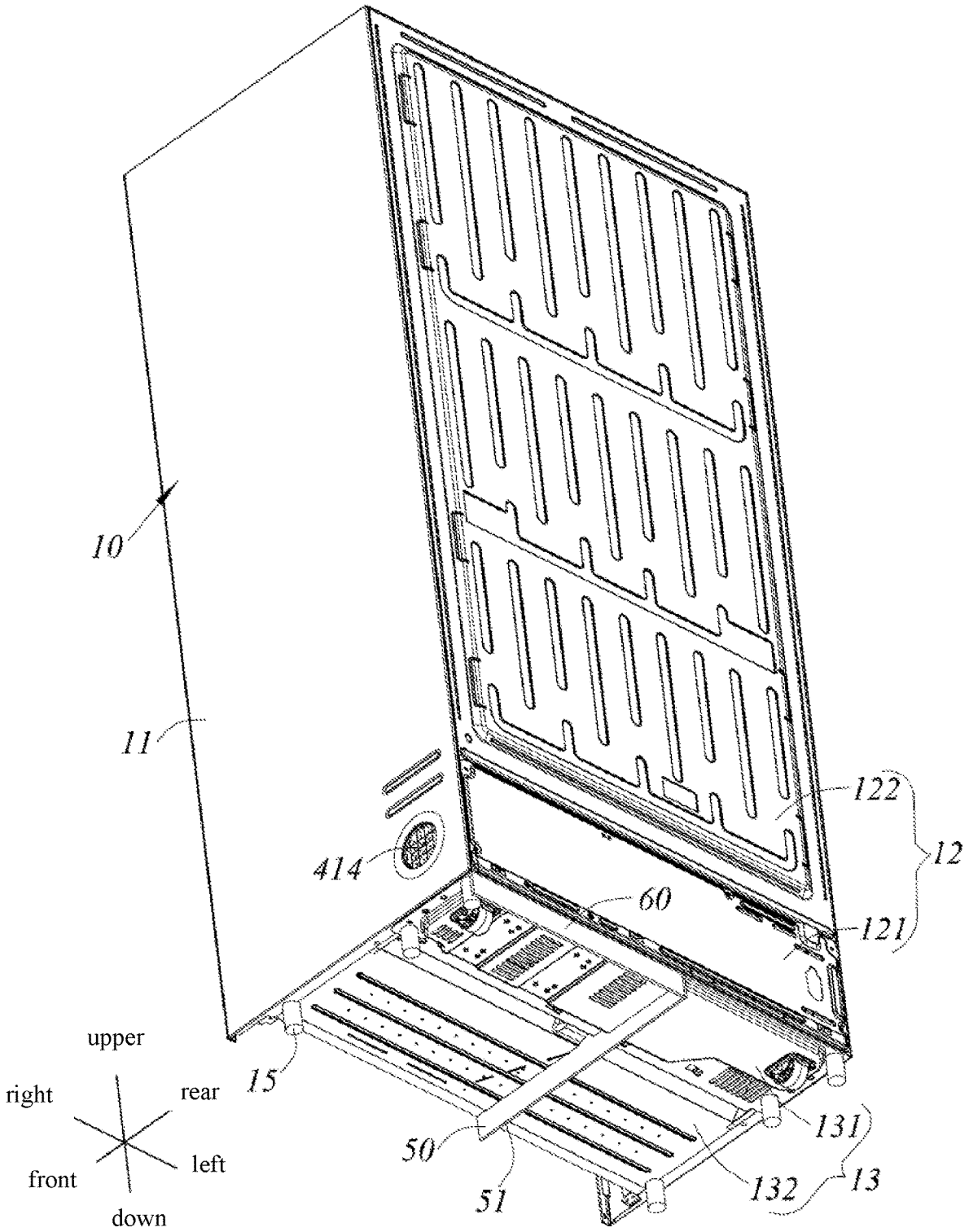
FIG. 1 is a partial schematic diagram of a refrigerator according to an embodiment of the present invention.
Figure 2:
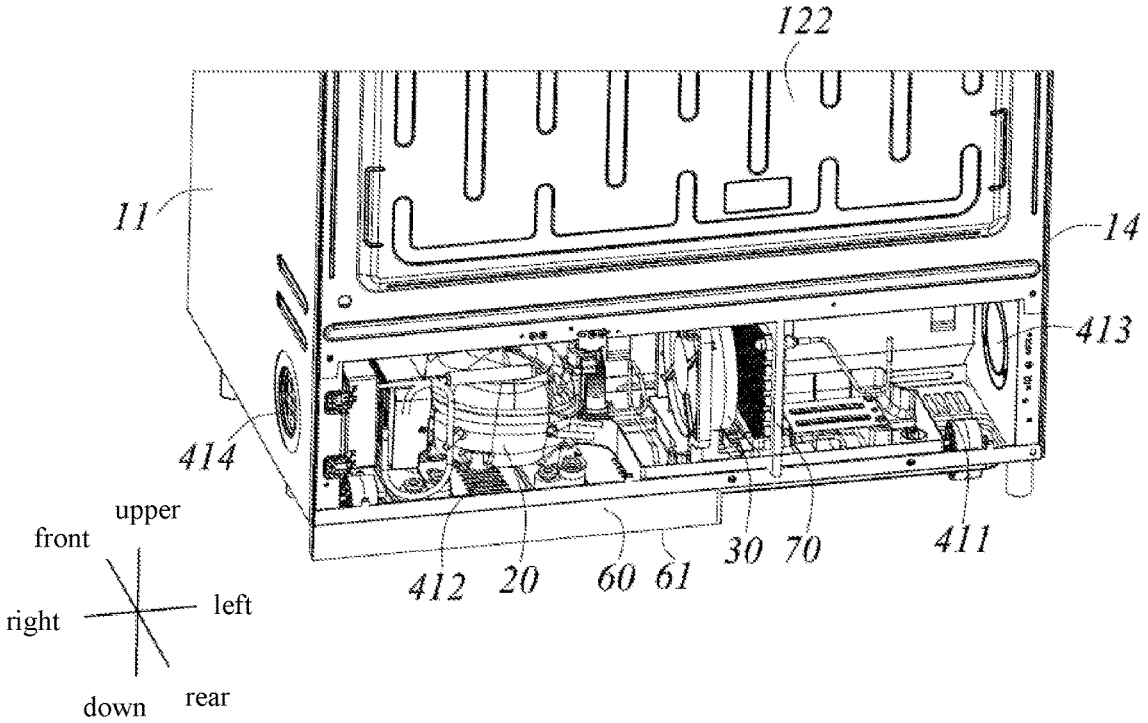
FIG. 2 is a partial schematic diagram of a refrigerator according to an embodiment of the present invention.
Figure 3:
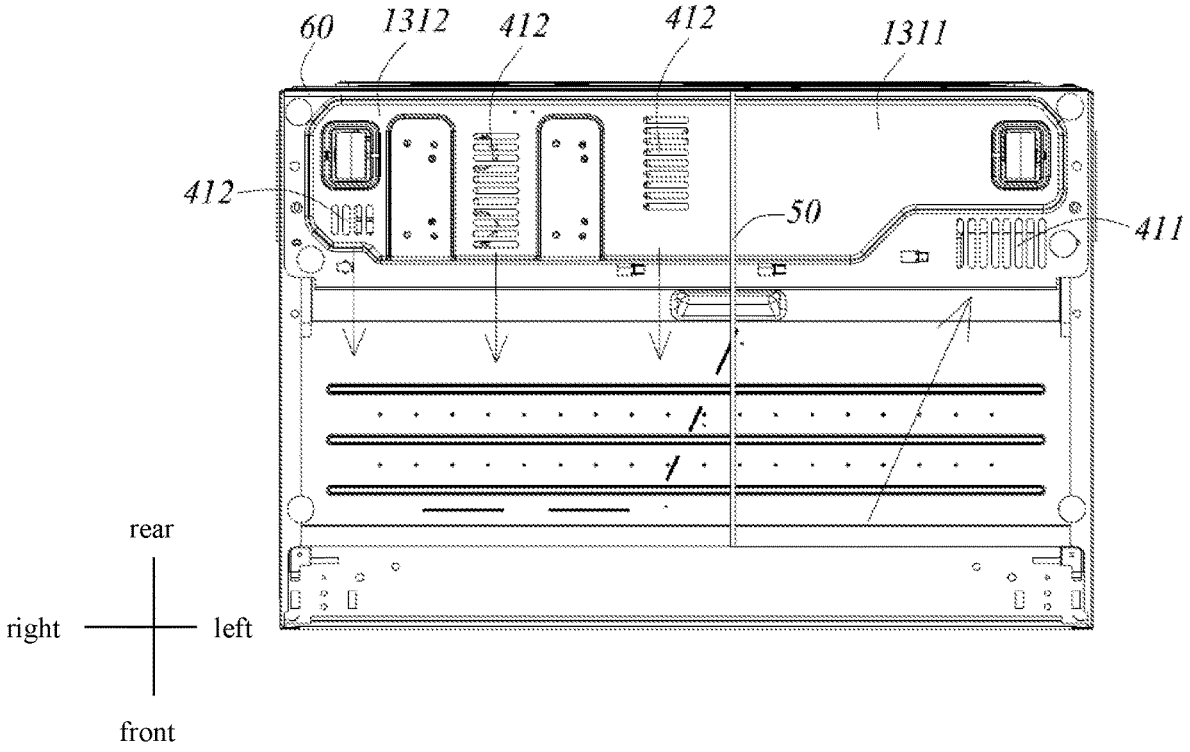
FIG. 3 is a schematic diagram of a bottom of a refrigerator according to an embodiment of the present invention.

It needs to be appreciated that unless otherwise specified and limited, in this application, referring to FIGS. 1 through 3, the orientation or position relationships indicated by terms "center", "longitudinal", "transverse", "up", "down", "front", "back", "left", "right", "vertical", "horizontal", "top", "bottom", "inside" and "outside" are determined from an view angle that a user faces the side of a door of the refrigerator, and are only intended to facilitate description, and not intended to indicate or imply that the mentioned devices or element must have a specific orientation and be constructed and operated with the specific orientation.

Referring to FIG. 1 through FIG. 3, an embodiment of the present invention provides a recessed refrigerator, which is disposed in an installation space in a wall cabinet, a wall or a cupboard. The refrigerator comprises a cabinet 10, a door movably disposed at a front side of the cabinet 10, a storage chamber surrounded by the cabinet 10 and the door, feet 15, a compressor compartment, a compressor 20, a condenser 70 and a heat dissipating fan 30.

The cabinet 10 defines at least a portion of an outer boundary of the refrigerator 100, which comprises a left side plate 14 and a right side plate 11 arranged opposite to each other in a left-right direction, a top plate and a bottom plate 13 arranged opposite to each other in an upper-down direction, and a back plate 12 arranged opposite to the door. The storage chamber is used to store articles, and specifically comprises a refrigerating compartment 20 for refrigerating food, a freezing compartment for freezing food, a variable temperature compartment and so on. The door is used to open and close the storage chamber.

The refrigerator is supported on a supporting surface (such as a cupboard surface or a floor) by using the feet 15, and lower ends of the feet 15 project downward out of the bottom plate 13. When the refrigerator is supported on the supporting surface, the bottom plate 13 is disposed apart from the supporting surface.

The compressor compartment is an accommodating space, which is surrounded by the cabinet 10 and is formed at a rear lower portion of the refrigerator. Specifically, the cabinet 10 further comprises a compressor compartment top plate defining an upper boundary of the compressor compartment and a compressor compartment front plate defining a front boundary of the compressor compartment; the bottom plate 13 comprises a compressor compartment bottom plate 131 located below the compressor compartment and a bottom plate body 132 assembled with and connected to a front end of the compressor compartment bottom plate 131, and the compressor compartment bottom plate 131 defines a lower boundary of the compressor compartment; the back plate 12 comprises a compressor compartment back plate 121 located behind the compressor compartment and a back plate body 122 assembled with and connected to an upper end of the compressor compartment back plate 121, and the compressor compartment back plate 121 defines a rear boundary of the compressor compartment; the left side plate 14 defines a left boundary of the compressor compartment, and the right side plate 11 defines a right boundary of the compressor compartment. That is, the compressor compartment top plate, the compressor compartment front plate, the compressor compartment bottom plate 131, the compressor compartment back plate 121, the left side plate 14 and the right side plate 11 together enclose the compressor compartment.

The compressor 20, the condenser 70 and the heat dissipating fan 30 are all disposed in the compressor compartment. The compressor 20 and the condenser 70 release heat to the compressor compartment during operation; the heat dissipating fan 30 is used to drive air to flow to facilitate heat dissipation and temperature reduction of the compressor compartment, thereby implementing the heat dissipation of the compressor 20 and the condenser 70.

In the present embodiment, the refrigerator further comprises a main air inlet 411 and a main air outlet 412. The main air inlet 411 and the main air outlet 412 are formed on the compressor compartment bottom plate 131 and respectively communicate the external with the compressor compartment, wherein the main air inlet 411 allows external air to enter the compressor compartment, and the main air outlet 412 allows air to flow from the compressor compartment to the external. In this way, when the heat dissipating fan 30 operates, cold air from the external (between the bottom plate 13 and the supporting surface), driven by the heat dissipating fan 30, enters the compressor compartment through the main air inlet 411, and then flows to the external (between the bottom plate 13 and the support surface) through the main air outlet 412, thereby achieving heat dissipation. As such, the main air inlet 411 and the main air outlet 412 are disposed on the compressor compartment bottom plate 131, and the heat is dissipated from a lower part of the refrigerator, so that the heat in the compressor compartment is effectively and timely discharged and the refrigeration effect of the refrigerator is ensured. At the same time, the back plate 12 of the refrigerator may be set against to the cupboard or the wall, thereby saving space and avoiding the appearance of hygienic dead angles.

Preferably, in the present embodiment, the heat-dissipating fan 30 is provided as an axial flow fan of which axis extends in the left-right direction. In this way, through the positional relationship between the heat dissipating fan 30 and the main air inlet 411 and the main air outlet 412, the air flow rate may be effectively ensured and the heat dissipation rate may be improved.

Furthermore, the compressor 20 is relatively close to the side of the main air outlet 412, the condenser 70 is relatively close to the side of the main air inlet 411, and the heat dissipating fan 30 is located between the compressor 20 and the condenser 70. Preferably, the compressor 20 and the condenser 70 are located on a path where air flows from the main air inlet 411 to the main air outlet 412.

The number of the main air outlets 412 may be plural to enhance the heat dissipation rate. In the present embodiment, there are three main air outlets 412, one of which is located below the compressor 20. In other words, the main air outlet 412 is at least partially located below the compressor 20.

In addition, the refrigerator further comprises two secondary air ports communicating the external with the compressor compartment. The two secondary air ports are formed on the left side plate 14 and the right side plate 11, respectively. One of the secondary air ports acts as a secondary air inlet which allows the external air to enter the compressor compartment, and the other of the secondary air ports serves as a secondary air outlet which allows air to flow from the compressor compartment to the external. In the present embodiment, the heat dissipating fan 30 drives air to flow from left to right in the compressor chamber; correspondingly, the secondary air inlet 413 is formed on the left side plate 14, and the secondary air outlet 414 is formed on the right side plate 11. When the heat dissipating fan 30 operates, cold air from the external, driven by the heat dissipating fan 30, enters the compressor compartment through the secondary air inlet 413, and then flows to the external through the secondary air outlet 414, thereby achieving heat dissipation.

Preferably, the secondary air inlet 413 and the secondary air outlet 414 are disposed opposite to each other in the left-right direction, and the heat dissipating fan 30 is located between the secondary air inlet 413 and the secondary air outlet 414.

Furthermore, the refrigerator further comprises a partition plate 50 and a wind baffle 60 to optimize an airflow channel for heat dissipation.

Specifically, the partition plate 50 is connected to the bottom plate 13 and extends downward from the bottom plate 13, and is located between the main air inlet 411 and the main air outlet 412, that is, the main air inlet 411 and the main air outlet 412 are separately disposed on both sides of the partition plate 50. In this way, hot air discharged from the main air outlet 412 can be prevented from returning to the compressor compartment through the main air inlet 411, and the heat-dissipating efficiency can be ensured.

Preferably, a lower end face 51 of the partition plate 50 and a lower end face of the feet 15 are located at the same height. When the refrigerator is supported on the supporting surface, the partition plate 50 abuts against the supporting surface.

In the present embodiment, the partition plate 50 extends in the front-rear direction, and the compressor compartment bottom plate 131 is divided into two portions by the partition plate 50. Specifically, the compressor compartment bottom plate 131 comprises a left end portion 1311 on the left side of the partition plate 50 and a right end portion 1312 on the right side of the partition plate 50. Correspondingly, the main air inlet 411 is formed on the left end portion 1311, and the main air outlet 412 is formed on the right end portion 1312. Certainly, in an alternate embodiment, the positions of the main air inlet 411 and the main air outlet 412 can be swapped correspondingly according to the air flow direction driven by the heat dissipating fan 30.

A front end of the partition plate 50 is flush with a front end of the bottom plate 13, and a rear end of the partition plate 50 is flush with a rear end of the bottom plate 13, that is, a width of the partition plate 50 in the front-rear direction is the same as the width of the bottom plate 13 in the front-rear direction, so that the air flow on the left and right sides of the partition plate 50 is always kept separated in a space formed by the bottom plate 13 and the supporting surface.

The wind baffle 60 extends downward out of the bottom plate 13, that is, a lower end face 61 of the wind baffle 60 is lower than the bottom plate 13. The wind baffle 60 is connected to the partition plate 50 and located behind the main air outlet 412. In this way, the hot air discharged from the main air outlet 412 can be prevented from flowing backward to the rear of the back plate 12 and staying in the rear of the back plate 12 to cause a poor heat dissipation effect or cause the back plate 12 to heat up.

Preferably, the lower end surface 61 of the wind baffle 60 is flush with the lower end face 51 of the partition plate 50. When the refrigerator is supported on the supporting surface, the wind baffle 60 abuts against the supporting surface.

In addition, the wind baffle 60 is disposed below the compressor compartment back plate 121. Furthermore, in the present embodiment, the main air outlet 412 is formed on the right end portion 1312, and the wind baffle 60 extends from the partition plate 50 in a left-right direction to below the right side plate 11. Certainly, in an alternate embodiment, when the main air outlet 412 is formed on the left end portion 1311, correspondingly the wind baffle 60 extends from the partition plate 50 in the left-right direction to below the left side plate 14.

As compared with the prior art, the refrigerator in the present embodiment has the following advantageous effects: the heat in the compressor compartment can be effectively and timely discharged and the refrigeration effect of the refrigerator can be ensured; at the same time, the back plate 12 of the refrigerator may be set against to the cupboard or the wall, thereby saving space and avoiding the appearance of hygienic dead angles.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

A series of the detailed descriptions set forth above is merely specific description of feasible embodiments of the present invention, and is not intended to limit the protection scope of the present invention. Equivalent embodiments or modifications made within the spirit of the present invention shall fall within the protection scope of the present invention.

What is claimed is:

1. A recessed refrigerator, supported on a supporting surface, comprising a cabinet, feet, a door movably disposed at a front side of the cabinet, a compressor compartment formed in a rear lower portion of the refrigerator and a compressor and a heat dissipating fan located in the compressor compartment;

wherein the cabinet comprising a bottom plate, a left side plate at a left end of the compressor compartment, a right side plate at a right end of the compressor compartment;

lower ends of the feet project downward out of the bottom plate, when the refrigerator is supported on the supporting surface by using the feet, the bottom plate being disposed apart from the supporting surface; and the bottom plate comprising a compressor compartment bottom plate located below the compressor compartment, the compressor compartment bottom plate being formed with a main air inlet and a main air outlet communicating an external environment of the refrigerator with the compressor compartment, air from the external environment of the refrigerator, driven by the heat dissipating fan, entering the compressor compartment through the main air inlet and then flowing to the external environment of the refrigerator through the main air outlet;

the recessed refrigerator further comprises a partition plate extending downward from the bottom plate and located between the main air inlet and the main air outlet, and a wind baffle extending downward out of the bottom plate;

the partition plate extends in a front-rear direction, the compressor compartment bottom plate comprises a left end portion on a left side of the partition plate and a right end portion on a right side of the partition plate, the main air inlet is formed on one of the left end portion and the right end portion, and the main air outlet is formed on the other of the left end portion and the right end portion;

the wind baffle is connected to the partition plate and located behind the main air outlet, when the main air outlet is formed on the left end portion, the wind baffle extends from the partition plate in a left-right direction to below the left side plate of the cabinet; when the main air outlet is formed on the right end portion, the wind baffle extends from the partition plate in the left-right direction to below the right side plate of the cabinet;

when the refrigerator is supported on the supporting surface, both of the partition plate and the wind baffle abut against the supporting surface.

2. The recessed refrigerator according to claim 1, wherein a front end of the partition plate is flush with a front end of the bottom plate.

3. The recessed refrigerator according to claim 1, wherein the main air outlet is at least partially located below the compressor.

4. The recessed refrigerator according to claim 1, wherein the cabinet further comprises two secondary air ports, the two secondary air ports are formed on the left side plate and the right side plate respectively and communicate the external environment of the refrigerator with the compressor compartment, one of the secondary air ports allows external air to enter the compressor compartment, and the other of the secondary air ports allows air to flow from the compressor compartment to the external environment of the refrigerator.

* * * * *